US012098526B2

(12) United States Patent
Takaoka

(10) Patent No.: US 12,098,526 B2
(45) Date of Patent: Sep. 24, 2024

(54) SYSTEM AND METHOD FOR AUTOMATICALLY CONTROLLING WORK MACHINE INCLUDING WORK IMPLEMENT

(71) Applicant: KOMATSU LTD., Tokyo (JP)

(72) Inventor: Yukihisa Takaoka, Tokyo (JP)

(73) Assignee: KOMATSU LTD., Tokyo (JP)

( * ) Notice: Subject to any disclaimer, the term of this patent is extended or adjusted under 35 U.S.C. 154(b) by 644 days.

(21) Appl. No.: 17/273,476

(22) PCT Filed: Sep. 17, 2019

(86) PCT No.: PCT/JP2019/036367
§ 371 (c)(1),
(2) Date: Mar. 4, 2021

(87) PCT Pub. No.: WO2020/105260
PCT Pub. Date: May 28, 2020

(65) Prior Publication Data

US 2021/0317640 A1 Oct. 14, 2021

(30) Foreign Application Priority Data

Nov. 19, 2018 (JP) ..... 2018-216702

(51) Int. Cl.
*E02F 9/26* (2006.01)
*E02F 9/20* (2006.01)

(52) U.S. Cl.
CPC ..... *E02F 9/262* (2013.01); *E02F 9/2041* (2013.01); *E02F 9/205* (2013.01); *E02F 9/265* (2013.01)

(58) Field of Classification Search
CPC ..... E02F 9/262; E02F 9/2041; E02F 9/205; E02F 9/265
See application file for complete search history.

(56) References Cited

U.S. PATENT DOCUMENTS 5,462,122 A 10/1995 Yamamoto et al.
9,469,967 B2 10/2016 Edara et al.
(Continued)

FOREIGN PATENT DOCUMENTS

JP 7-26586 A 1/1995
JP 9-21131 A 1/1997
JP 2016-132912 A 7/2016

OTHER PUBLICATIONS

The International Search Report for the corresponding international application No. PCT/JP2019/036367, issued on Dec. 10, 2019.

*Primary Examiner* — Andrew J Cromer
(74) *Attorney, Agent, or Firm* — Global IP Counselors, LLP

(57) ABSTRACT

A system automatically controls a work machine including a work implement. The system includes a processor. The processor controls the work machine by selectively executing a normal digging mode in order to dig an actual topography at a work site, and a wall digging mode in order to dig a digging wall formed between a plurality of slots by digging the actual topography. When the wall digging mode is executed, the processor acquires starting edge position data indicative of a position of a starting edge of the digging wall. The processor determines a digging starting position based on the position of the starting edge of the digging wall. The processor controls the work machine to dig the digging wall from the digging starting position.

20 Claims, 13 Drawing Sheets

(56) References Cited

U.S. PATENT DOCUMENTS

| | | | | |
|---|---|---|---|---|
| 2012/0136508 | A1 | 5/2012 | Taylor et al. | |
| 2016/0076224 | A1* | 3/2016 | Edara | E02F 9/2029 701/50 |
| 2016/0077514 | A1* | 3/2016 | Taylor | G05D 1/0217 700/173 |

* cited by examiner

SYSTEM AND METHOD FOR AUTOMATICALLY CONTROLLING WORK MACHINE INCLUDING WORK IMPLEMENT

CROSS-REFERENCE TO RELATED APPLICATIONS

This application is a U.S. National stage application of International Application No. PCT/JP2019/036367, filed on Sep. 17, 2019. This U.S. National stage application claims priority under 35 U.S.C. § 119(a) to Japanese Patent Application No. 2018-216702, filed in Japan on Nov. 19, 2018, the entire contents of which are hereby incorporated herein by reference.

BACKGROUND

Field of the Invention

The present invention relates to a system and a method for controlling a work machine including a work implement.

Background Information

Slot dozing is work performed by a work machine such as a bulldozer. In slot dozing, the actual topography of a work site is dug by the work implement whereby a plurality of slots are formed in the actual topography. Moreover, digging walls are formed between the plurality of slots. The digging walls are berms left over along the slots. Such types of digging walls are preferably removed.

U.S. Pat. No. 9,469,967 describes a starting condition for work to dig and remove the digging walls. For example, a controller determines whether to start digging of a digging wall based on the difference in the depths of the slots adjacent to the digging wall on both sides, or the width of the digging wall.

SUMMARY

However, the motions of the work machine for digging the digging walls are not disclosed in U.S. Pat. No. 9,469,967 An object of the present invention is to provide a system and a method for digging a digging wall by automatically controlling a work machine.

A system according to a first aspect is a system for automatically controlling a work machine including a work implement. The system includes a processor. The processor selectively executes a normal digging mode and a wall digging mode. The normal digging mode is a control mode for digging an actual topography at a work site. The wall digging mode is a control mode for digging a digging wall formed between a plurality of slots by the digging of the actual topography.

The processor acquires starting edge position data which indicates the position of a starting edge of a digging wall when the wall digging mode is executed. The processor determines a digging starting position based on the position of the starting edge of the digging wall. The processor controls the work machine to dig the digging wall from the digging starting position.

A method according to a second aspect is a method executed by a processor for automatically controlling a work machine including a work implement. The method includes the following processes. A first process is selectively executing a normal digging mode for digging an actual topography at a work site, and a wall digging mode for digging a digging wall formed between a plurality of slots by the digging of the actual topography. A second process is acquiring starting edge position data which indicates the position of a starting edge of the digging wall when the wall digging mode is executed. A third process is determining a digging starting position based on the position of the starting edge of the digging wall. A fourth process is controlling the work machine to dig the digging wall from the digging starting position.

According to the present invention, when the wall digging mode is executed, the digging starting position is determined based on the position of the starting edge of the digging wall and the work machine is controlled so as to dig the digging wall from the digging starting position. Consequently, the digging wall can be dug by automatic control of the work machine.

DETAILED DESCRIPTION OF EMBODIMENT(S)

Figure 1:
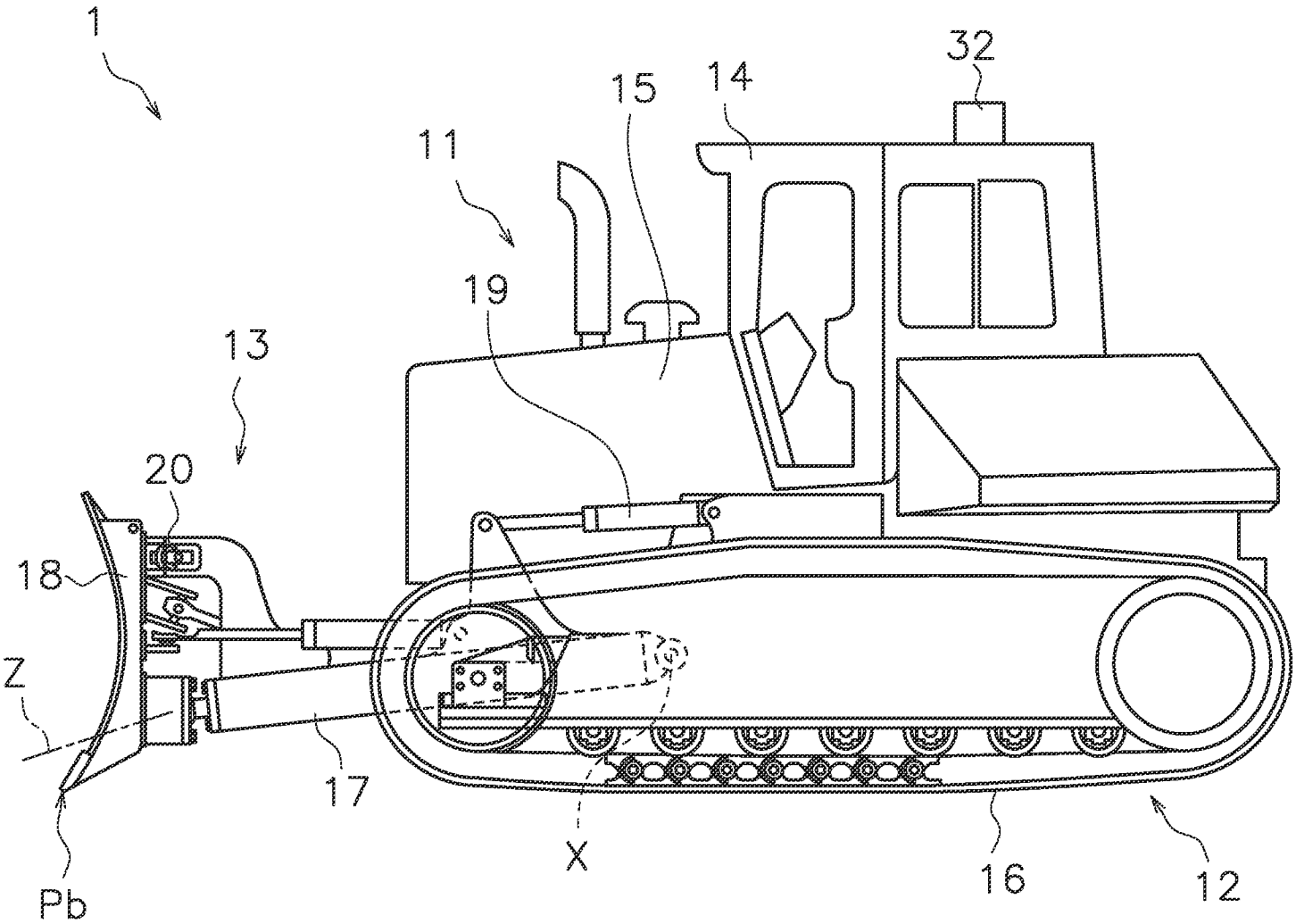
FIG. 1 is a side view of a work machine according to an embodiment.

A work machine according to an embodiment is discussed hereinbelow with reference to the drawings. FIG. 1 is a side view of a work machine 1 according to an embodiment. The work machine 1 according to the present embodiment is a bulldozer. The work machine 1 includes a vehicle body 11, a travel device 12, and a work implement 13.

The vehicle body 11 has an operator's cab 14 and an engine compartment 15. An operator's seat that is not illustrated is disposed inside the operator's cab 14. The engine compartment 15 is disposed in front of the operator's cab 14. The travel device 12 is attached to a bottom portion of the vehicle body 11. The travel device 12 includes a left and right pair of crawler belts 16. Only the crawler belt 16 on the left side is illustrated in FIG. 1. The work machine 1 travels due to the rotation of the crawler belts 16.

The work implement 13 is attached to the vehicle body 11. The work implement 13 has a lift frame 17, a blade 18, a lift cylinder 19, and a tilt cylinder 20. The lift frame 17 is attached to the vehicle body 11 in a manner that allows movement up and down centered on an axis X that extends in the vehicle width direction. The lift frame 17 supports the blade 18.

The blade 18 is disposed in front of the vehicle body 11. The blade 18 moves up and down accompanying the up and down movements of the lift frame 17. The lift frame 17 may be attached to the travel device 12. The lift cylinder 19 is coupled to the vehicle body 11 and the lift frame 17. Due to the extension and contraction of the lift cylinder 19, the lift frame 17 moves up and down centered on the axis X.

The tilt cylinder 20 is coupled to the lift frame 17 and the blade 18. Due to the extension and contraction of the tilt cylinder 20, the blade 18 tilts around an axis Z that extends in roughly the front-back direction of the work machine 1.

Figure 2:
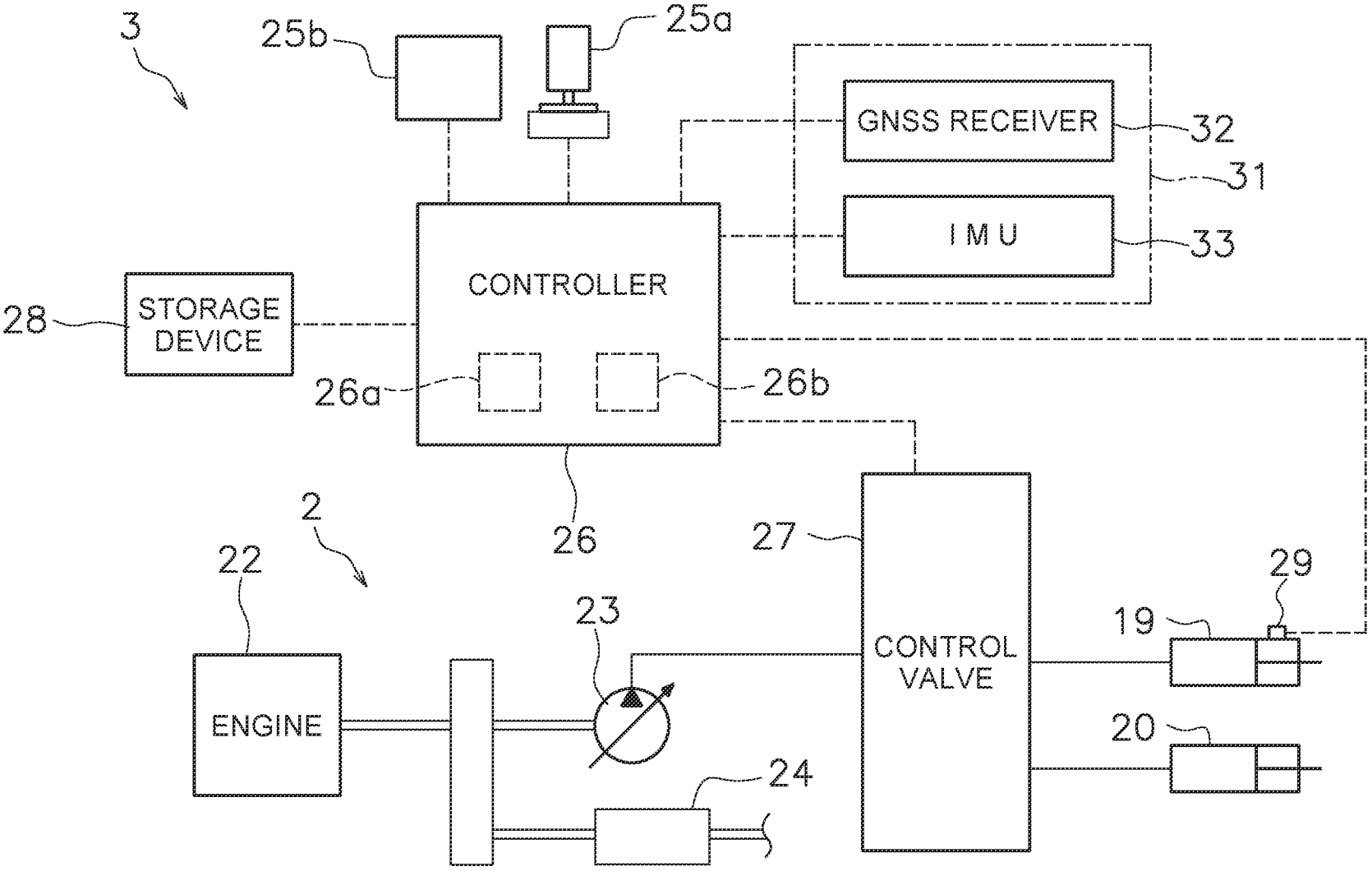
FIG. 2 is a block diagram illustrating a configuration of a drive system and a control system of the work machine.

FIG. 2 is a block diagram illustrating a configuration of a drive system 2 and a control system 3 of the work machine 1. As illustrated in FIG. 2, the drive system 2 includes an engine 22, a hydraulic pump 23, and a power transmission device 24.

The hydraulic pump 23 is driven by the engine 22 to discharge hydraulic fluid. The hydraulic fluid discharged from the hydraulic pump 23 is supplied to the lift cylinder 19 and the tilt cylinder 20. While only one hydraulic pump 23 is illustrated in FIG. 2, a plurality of hydraulic pumps may be provided.

The power transmission device 24 transmits driving power from the engine 22 to the travel device 12. The power transmission device 24 may be a hydrostatic transmission (HST), for example. Alternatively, the power transmission device 24, for example, may be a transmission having a torque converter or a plurality of speed change gears.

The control system 3 includes an operating device 25*a*, an input device 25*b*, a controller 26, a storage device 28, and a control valve 27. The operating device 25*a* and the input device 25*b* are disposed in the operator's cab 14. The operating device 25*a* is a device for operating the work implement 13, the travel device 12, the engine 22, and the power transmission device 24. The operating device 25*a* is disposed in the operator's cab 14.

The operating device 25*a* receives operations from an operator for driving the work implement 13 and outputs operation signals corresponding to the operations. The operating device 25*a* receives operations from the operator for causing the work machine 1 to travel, and outputs operation signals corresponding to the operations. The operation signals of the operating device 25*a* are output to the controller 26. The operating device 25*a* includes, for example, an operating lever, a pedal, and a switch and the like.

The input device 25*b* is a device for performing below-mentioned automatic control settings of the work machine 1. The input device 25*b* receives operations by an operator and outputs operation signals corresponding to the operations. The operation signals of the input device 25*b* are output to the controller 26. The input device 25*b* includes, for example, a touch screen. However, the input device 25*b* is not limited to a touch screen and may include hardware keys.

The controller 26 is programmed to control the work machine 1 based on acquired data. The controller 26 includes, for example, a processing device (processor) 26*a* such as a CPU, and a memory 26*b*. The memory 26*b* may include a volatile memory such as a RAM or the like, or a non-volatile memory such as a ROM or the like. The controller 26 acquires operation signals from the operating device 25*a* and the input device 25*b*. The controller 26 causes the work machine 1 to travel by controlling the travel device 12, the engine 22, and the power transmission device 24 in accordance with the operation signals. The controller 26 controls the control valve 27 in accordance with the operation signals to move the work implement 13.

The control valve 27 is a proportional control valve and is controlled with command signals from the controller 26. The control valve 27 is disposed between the hydraulic pump 23 and hydraulic actuators such as the lift cylinder 19 and the tilt cylinder 20. The control valve 27 controls the flow rate of the hydraulic fluid supplied from the hydraulic pump 23 to the lift cylinder 19 or the tilt cylinder 20. The controller 26 generates a command signal for the control valve 27 so as to cause the lift cylinder 19 or the tilt cylinder 20 to contract and expand. As a result, the motions of the blade 18 are controlled. The control valve 27 may also be a pressure proportional control valve. Alternatively, the control valve 27 may be an electromagnetic proportional control valve.

The control system 3 includes a work implement sensor 29. The work implement sensor 29 detects the position of the work implement 13 with respect to the vehicle body 11 and outputs work implement position data which indicates the position of the work implement 13. The work implement sensor 29 may be a displacement sensor that detects displacement of the work implement 13.

For example, the work implement sensor 29 may include a sensor for detecting the stroke length of the lift cylinder 19. The controller 26 may calculate the lift angle of the blade 18 based on the stroke length of the lift cylinder 19. The work implement sensor 29 may include a sensor for detecting the stroke length of the tilt cylinder 20. The controller 26 may calculate the tilt angle of the blade 18 based on the stroke length of the tilt cylinder 20.

As illustrated in FIG. 2, the control system 3 includes a positional sensor 31. The positional sensor 31 measures the position of the work machine 1. The positional sensor 31 includes a global navigation satellite system (GNSS) receiver 32 and an inertial measurement unit (IMU) 33. The GNSS receiver 32 is, for example, a receiving apparatus for a global positioning system (GPS). For example, an antenna of the GNSS receiver 32 is disposed on the operator's cab 14. However, the antenna of the GNSS receiver 32 may be disposed in another position.

The GNSS receiver 32 receives a positioning signal from a satellite, computes the position of the antenna from the positioning signal, and generates machine position data which indicates the position of the vehicle body 11. The controller 26 acquires the machine position data from the GNSS receiver 32. The controller 26 acquires the current position of the work machine 1 and the traveling direction and the vehicle speed of the work machine 1 from the machine position data.

The IMU 33 acquires vehicle body inclination angle data. The vehicle body inclination angle data includes the angle (pitch angle) with respect to horizontal in the front-back direction of the work machine 1, and the angle (roll angle) with respect to horizontal in the transverse direction of the work machine 1. The controller 26 acquires the vehicle body inclination angle data from the IMU 33.

The controller 26 computes a blade tip position Pb of the blade 18 from the work implement position data, the machine position data, and the vehicle body inclination angle data. For example, the controller 26 acquires global coordinates of the GNSS receiver 32 based on the machine position data. The controller 26 calculates local coordinates of the blade tip position Pb with respect to the GNSS receiver 32 based on the work implement position data. The controller 26 calculates the global coordinates of the blade tip position Pb based on the global coordinates of the GNSS receiver 32, the local coordinates of the blade tip position Pb, and the vehicle body inclination angle data. The controller 26 acquires the global coordinates of the blade tip position Pb as the current position data of the work implement 13.

The storage device 28 may be, for example, a semiconductor memory or a hard disk and the like. The storage device 28 is an example of a non-transitory computer-readable recording medium. The storage device 28 records computer commands that are executable by the processor and that are for controlling the work machine 1.

Automatic control of the work machine 1 executed by the controller 26 will be explained next. The automatic control of the work machine 1 may be a semi-automatic control that is performed in accompaniment to manual operations by the operator. Alternatively, the automatic control of the work machine 1 may be a fully automatic control that is performed without manual operations by an operator.

Figure 3:
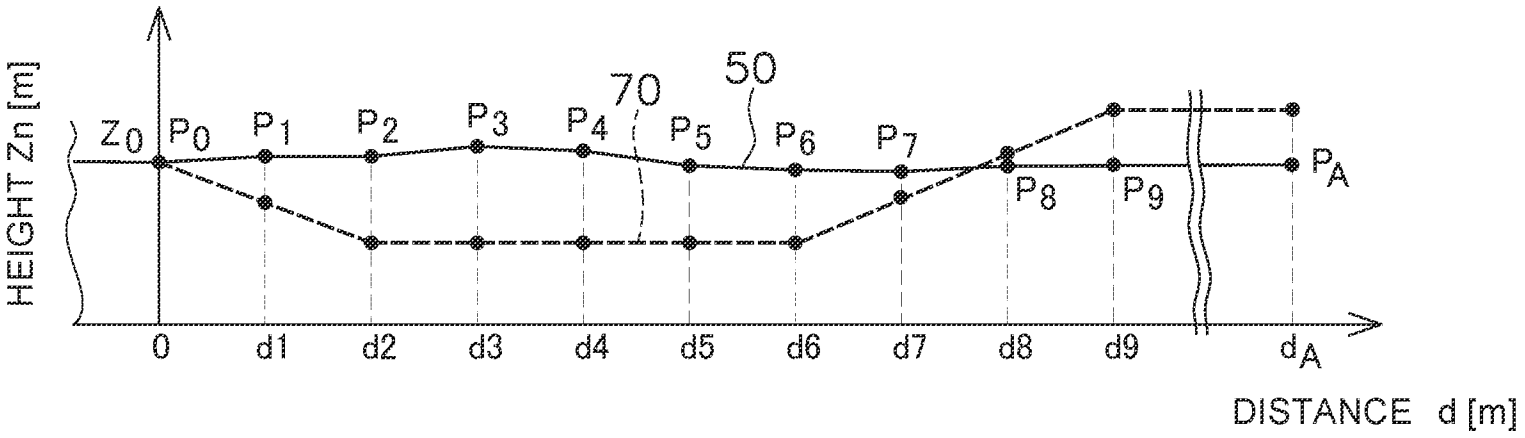
FIG. 3 is a cross-sectional view illustrating an example of an actual topography as seen from the vehicle width direction.

The controller 26 automatically controls the work machine 1 based on actual topography data, design topography data, and current position data. The actual topography data and the design topography data are stored in the storage device 28. The actual topography data indicates an actual topography 50 of the work site as illustrated in FIG. 3. The actual topography data is information which indicates the current topography of the work site located in the traveling direction of the work machine 1. FIG. 3 illustrates a cross-section of actual topography 50. In FIG. 3, the vertical axis indicates the height of the topography and the horizontal axis indicates the distance from the current position in the traveling direction of the work machine 1.

Specifically, the actual topography 50 is represented in the actual topography data by the height Zn of the actual topography 50 at a plurality of reference points Pn (n=1, 2, . . . , A) on the travel path of the work machine 1. The plurality of reference points Pn indicate a plurality of spots at predetermined intervals in the traveling direction of the work machine 1. The predetermined distance may be, for example, 1 m. However, the predetermined distance may be shorter than 1 m or longer than 1 m.

The actual topography data is acquired by an external device and saved in the storage device 28. The actual topography data may be acquired by means of the controller 26 recording the locus of a portion of the work machine 1 such as the blade tip position Pb or the crawler belts 16, etc. Alternatively, the actual topography data may be acquired by means of carrying out distance surveying on the actual topography 50 with an on-board laser imaging detection and ranging device (LIDAR).

The design topography data indicates a target design topography 70. The target design topography 70 represents a target locus of the blade tip of the blade 18 during the work. The target design topography 70 indicates the desired topography as a result of the work by the work implement 13. The target design topography 70 is represented by the height Zn of the target design topography 70 at the plurality of reference points Pn in the same way as the actual topography 50. The target design topography 70 may be generated by the controller 26 based on the actual topography data. Alternatively, the target design topography 70 may be generated by the controller 26 based on the capability of the work machine 1 such as the capacity of the blade 18. Alternatively, the target design topography 70 may be acquired by an external device.

Figure 4:
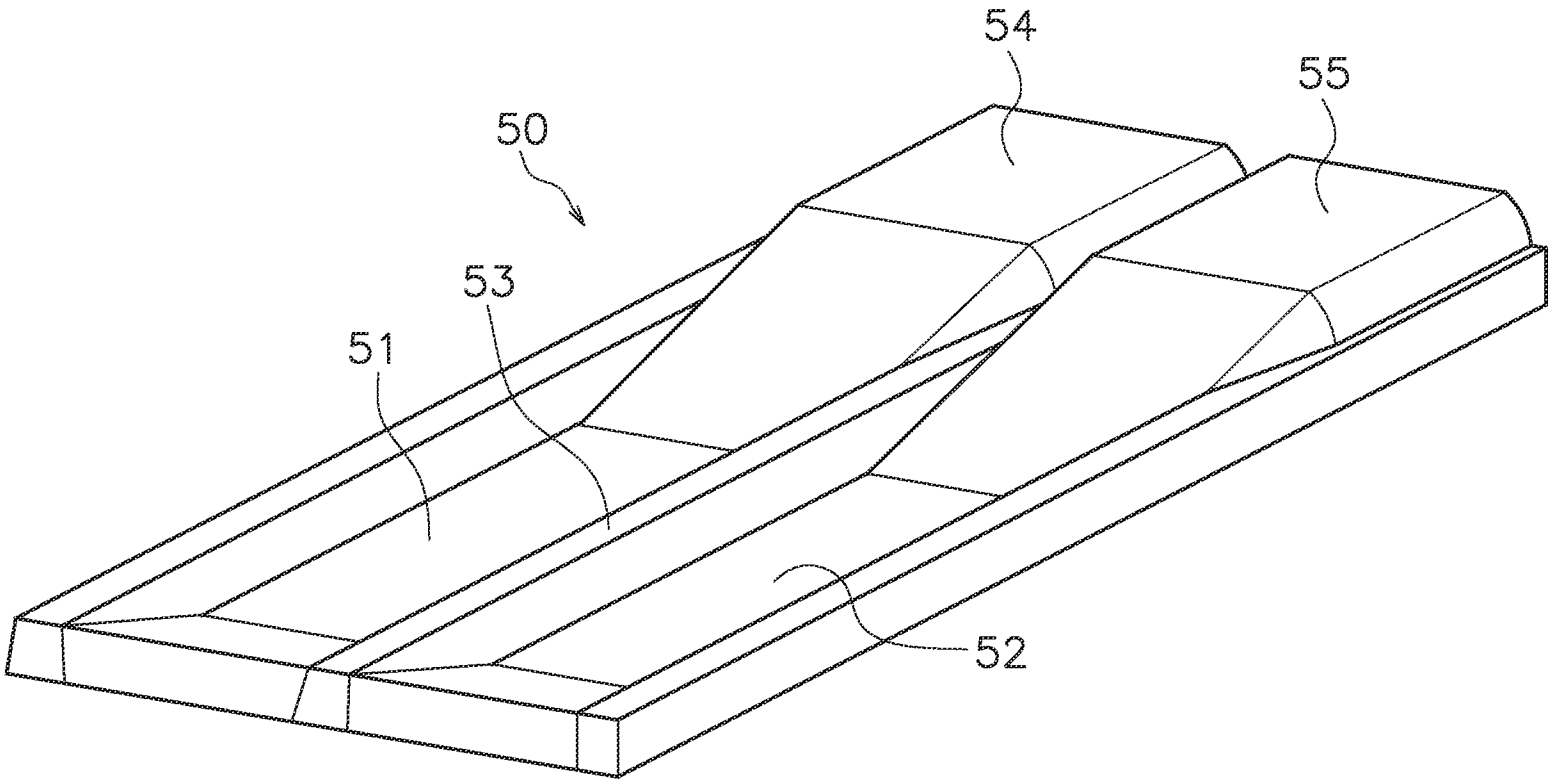
FIG. 4 is a perspective view illustrating an example of the actual topography in which slots and digging walls are formed.

The controller 26 selectively executes a normal digging mode and a wall digging mode. The normal digging mode is a control mode for digging the actual topography 50 as illustrated in FIG. 4. Slots 51 and 52 are formed in the actual topography 50 as a result of the normal digging mode. The wall digging mode is a control mode for digging a digging wall 53 formed between the plurality of slots 51 and 52. The controller 26 may also execute another control mode different from the normal digging mode and the wall digging mode.

Figure 5:
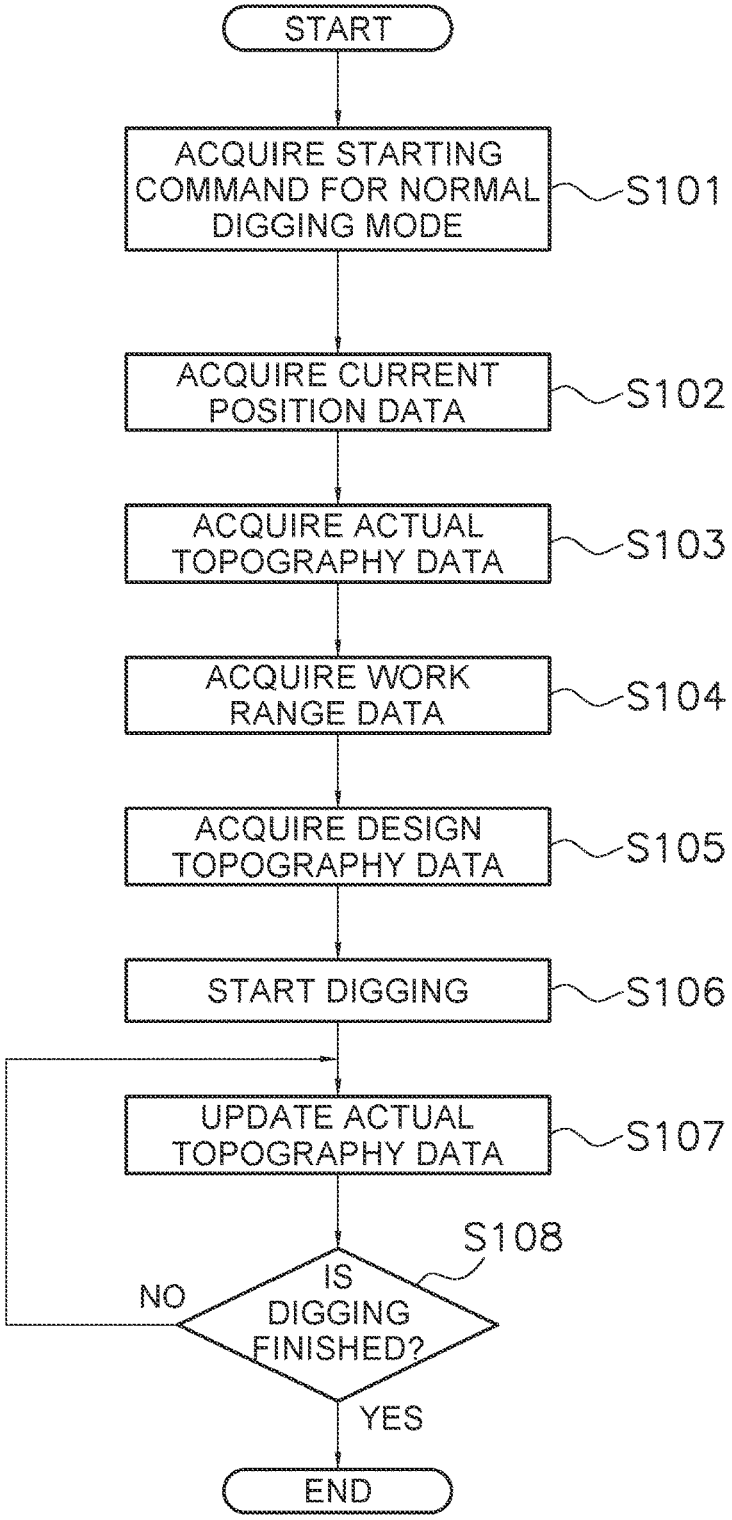
FIG. 5 is a flow chart illustrating processing of automatic control during a normal digging mode.

FIG. 5 is a flow chart illustrating processing of automatic control during the normal digging mode. As illustrated in FIG. 5, the controller 26 acquires a starting command for the normal digging mode in step S101. The normal digging mode may be selected by the operator operating the input device 25*b*. That is, the controller 26 may decide to execute the normal digging mode based on an operation signal from the input device 25*b*.

Alternatively, a previously set construction plan may be saved in the storage device 28 and the controller 26 may decide to execute the normal digging mode according to the construction plan. Alternatively, the controller 26 may decide to execute the normal digging mode by determining whether a predetermined starting condition has been satisfied based on a parameter such as the shape of the actual topography 50.

Figure 6:
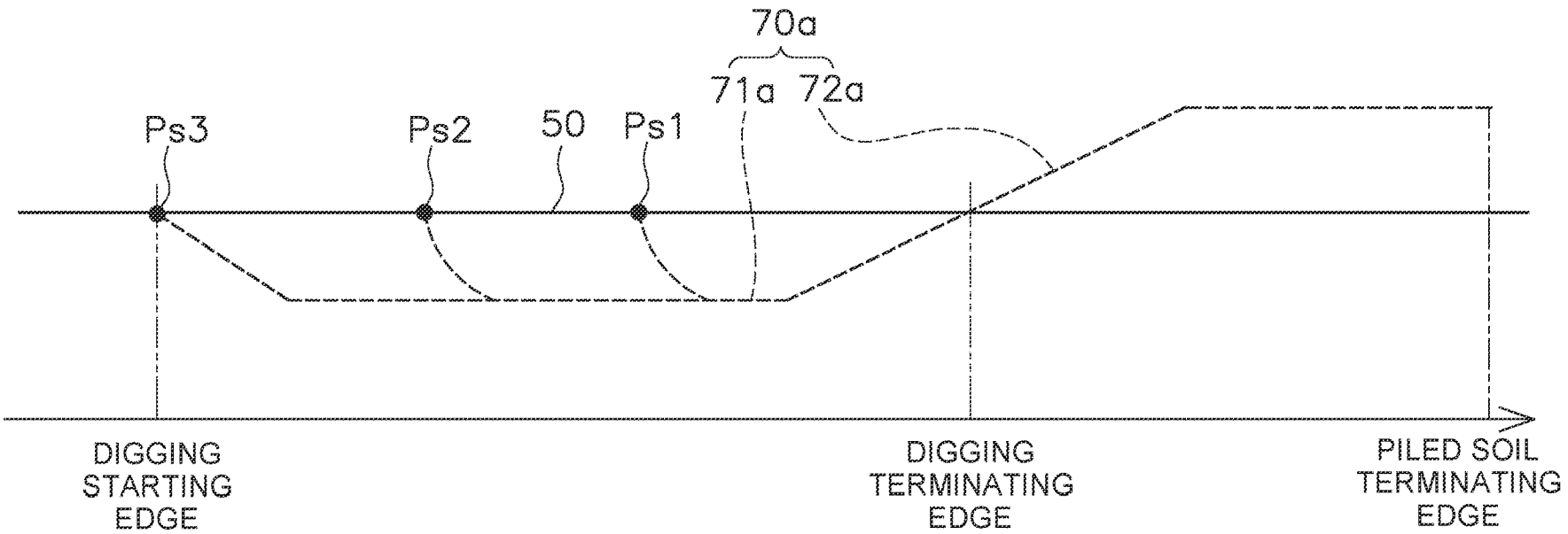
FIG. 6 is a cross-sectional view illustrating an example of an actual topography and a target design topography as seen from the vehicle width direction during the normal digging mode.

In step S102, the controller 26 acquires the abovementioned current position data. The controller 26 continuously acquires and updates the current position data during the execution of the following processes. In step S103, the controller 26 acquires the abovementioned actual topography data. FIG. 6 illustrates an example of the actual topography 50 during the normal digging mode.

In step S104, the controller 26 acquires work range data. As illustrated in FIG. 6, the work range includes the starting edge and the terminating edge of the digging. The work range data includes starting edge position data and terminating edge position data of the digging. The starting edge position data of the digging indicates the digging starting edge. The terminating edge position data of the digging indicates the digging terminating edge.

The starting edge position and the terminating edge position of the digging may be set with the input device 25*b*. Alternatively, the starting edge position and the distance of a digging range of the digging may be set with the input device 25*b*, and the terminating edge position of the digging may be determined by computing. Alternatively, the terminating edge position and the distance of the digging range of the digging may be set with the input device 25*b*, and the starting edge position of the digging may be determined by computing.

In addition, the work range includes the terminating edge position of the piled soil. The piled soil is a result of the work for discharging the soil dug and held by the blade 18 onto the actual topography 50. The work range data includes terminating edge position data of the piled soil. The terminating edge position data of the piled soil indicates the terminating edge position of the piled soil. The terminating edge position of the piled soil may be set with the input device 25*b*. Alternatively, the length of the piled soil range may be set with the input device 25*b*, and the terminating edge position of the piled soil may be determined by computing.

The controller 26 acquires the work range data based on operation signals from the input device 25*b*. However, the controller 26 may acquire the work range data with another method. For example, the controller 26 may acquire the work range data from an external device.

In step S105, the controller 26 acquires the design topography data. For example, the controller 26 determines a target design topography 70*a* as depicted in FIG. 6. The target design topography 70*a* includes a first target topography 71*a* and a second target topography 72*a*. At least a portion of the first target topography 71*a* is located below the actual topography 50. At least a portion of the second target topography 72*a* is located above the actual topography 50.

The controller 26 may determine the target design topography 70*a* in accordance with the actual topography 50. For example, the controller 26 may determine the first target topography 71*a* so as to be located below the actual topography 50 by a predetermined distance. The controller 26 may determine the first target topography 71*a* so as to be sloped at a predetermined angle to the actual topography 50 or to the horizontal direction.

The controller 26 may determine the second target topography 72*a* so as to be located above the actual topography 50 by a predetermined distance. The controller 26 may determine the second target topography 72*a* so as to be sloped at a predetermined angle to the actual topography 50 or to the horizontal direction. Alternatively, the target design topography 70*a* may be determined in advance.

In step S106, the controller 26 starts the digging. The controller 26 controls the work machine 1 in accordance with the target design topography 70*a*. The controller 26 causes the work machine 1 to travel forward from the starting edge to the terminating edge of the digging and controls the work implement 13 so that the blade tip position Pb of the blade 18 moves in accordance with the first target topography 71*a*. The actual topography 50 is dug due to the blade tip of the blade 18 moving along the first target topography 71*a*. Consequently, the slots 51 and 52 are formed in the actual topography 50 as illustrated in FIG. 4.

The controller 26 also causes the work machine 1 to travel forward from the digging terminating edge to the terminating edge of the piled soil and controls the work implement 13 so that the blade tip position Pb of the blade 18 moves in accordance with second first target topography 71*b*. The soil dug and held by the blade 18 is piled on the actual topography 50 due to the blade tip of the blade 18 moving along the second target topography 71*b*. Consequently, piles of piled soil 54 and 55 are formed on the actual topography 50 as illustrated in FIG. 4.

As illustrated in FIG. 6, the controller 26 may set a plurality of digging starting positions Ps1 to Ps3 between the starting edge and the terminating edge of the digging. The controller 26 may execute the digging from the digging starting position Ps1 nearer to the terminating edge and thereafter execute the digging of the digging starting positions Ps2 and Ps3 in order.

For example, the controller 26 controls the work machine 1 so as to first perform the digging from the first starting position Ps1 to the digging terminating edge, and then perform the soil piling toward the terminating edge of the piled soil by crossing over the digging terminating edge. Next, the controller 26 causes the work machine 1 to travel in reverse to the second starting position Ps2. The controller 26 then controls the work machine 1 so as to start digging from the second starting position Ps2 and perform the digging and soil piling in the same way as explained above. Next, the controller 26 causes the work machine 1 to travel in reverse to the third starting position Ps3. The controller 26 then controls the work machine 1 so as to start digging from the third starting position Ps3 and perform the digging and soil piling in the same way as explained above.

In step S107, the controller 26 updates the actual topography data. The controller 26 updates the actual topography data with position data that represents the most recent locus of the blade tip position Pb. Alternatively, the controller 26 may calculate the position of the bottom surface of the crawler belts 16 and update the actual topography data with the position data that indicates the locus of the bottom surfaces of the crawler belts 16.

Alternatively, the actual topography data may be updated from survey data measured by a surveying device outside of the work machine 1. For example, aerial laser surveying may be used as the external surveying device. Alternatively, the actual topography 50 may be imaged by a camera and work site topography data may be generated from image data captured by the camera. For example, aerial photography surveying performed with an unmanned aerial vehicle (UAV) may be used. The updating of the actual topography data may be performed at predetermined periods or at any time.

The work from the digging starting edge to the terminating edge of the piled soil is set as a one unit of work, and when one unit of work is completed, the controller 26 causes the work machine 1 to move to the side of the previously formed slot 51. The second slot 52 is then formed by executing the processing from steps S101 to S107 again.

For example, as illustrated in FIG. 4, after causing the work machine 1 to operate so as to form the first slot 51, the controller 26 causes the work machine 1 to move to the side and causes the work machine 1 to operate so as to form the second slot 52 laterally adjacent to the first slot 51. The controller 26 may start forming the second slot 52 after repeating a plurality of units of work to form the first slot 51.

In step S108, the controller 26 determines whether to finish the digging. For example, the controller 26 may decide to finish the digging in accordance with the operation of the input device 25*b*. Alternatively, the controller 26 may decide to finish the digging in accordance with a previously set construction plan. Alternatively, the controller 26 may decide to finish the digging by determining whether a predetermined finishing condition is satisfied.

When the forming of the first slot 51 is finished and the forming of the second slot 52 starts, the controller 26 causes the work machine 1 to move further to the side than the width of the blade 18. As a result, the digging wall 53 is formed between the first slot 51 and the second slot 52. The digging wall 53 is a berm of soil along the slots 51 and 52.

Figure 7:
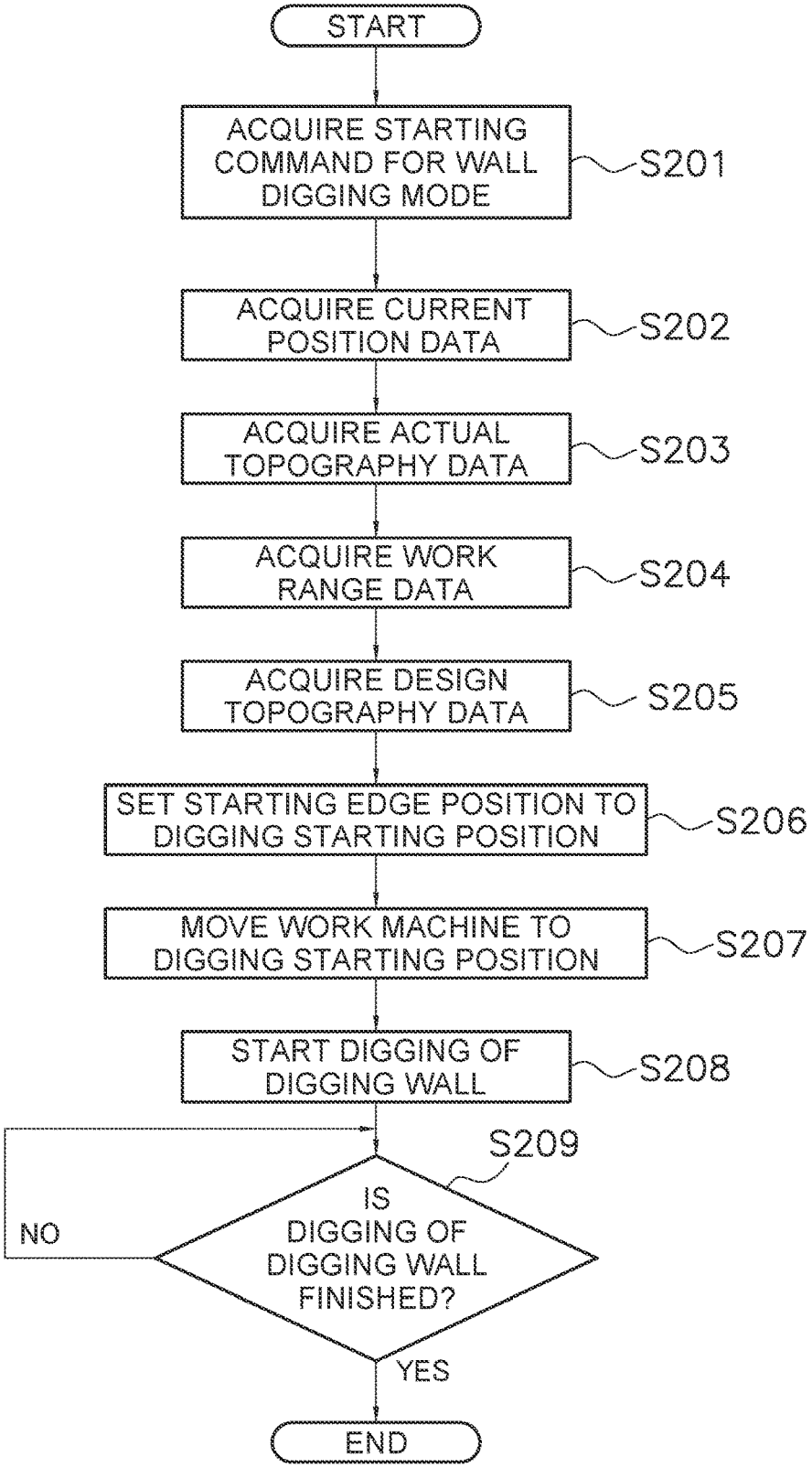
FIG. 7 is a flow chart illustrating processing of automatic control during a wall digging mode.

FIG. 7 is a flow chart illustrating processing of automatic control during the wall digging mode. in step S201, the controller 26 acquires a starting command for the wall digging mode. The wall digging mode may be selected by the operator operating the input device 25*b*. That is, the controller 26 may decide to execute the wall digging mode based on an operation signal from the input device 25*b*.

Alternatively, the controller 26 may decide to execute the wall digging mode in accordance with a previously set construction plan. Alternatively, the controller 26 may decide to execute the wall digging mode by determining whether a predetermined starting condition is satisfied.

Figure 8:
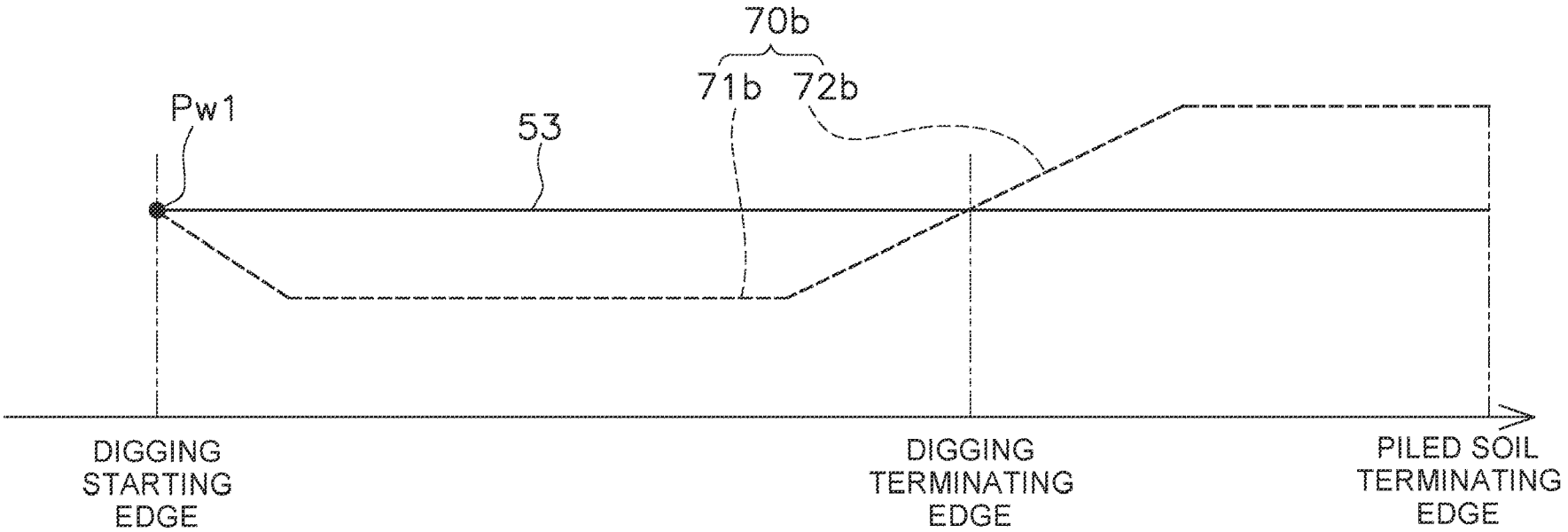
FIG. 8 is a cross-sectional view illustrating an example of an actual topography and a target design topography as seen from the vehicle width direction during the wall digging mode.
Figure 9:
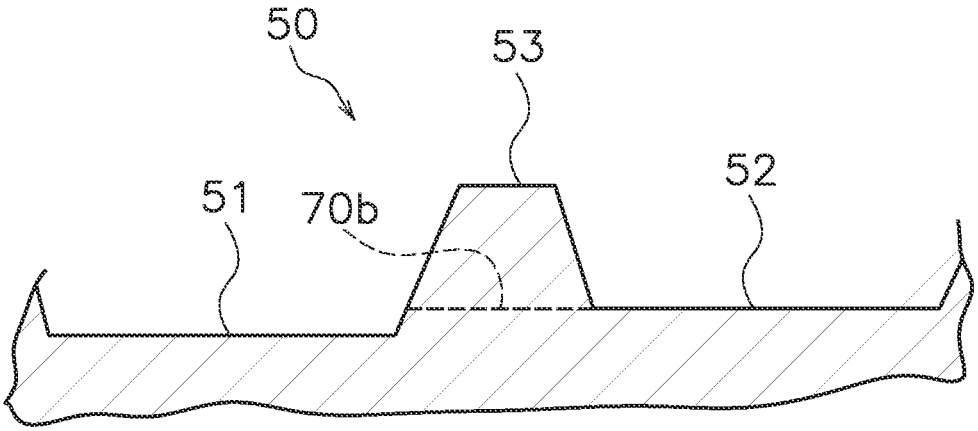
FIG. 9 is a cross-sectional view illustrating an example of the actual topography as seen from the traveling direction of the work machine.

In step S202, the controller 26 acquires the current position data in the same way as step S102. In step S203, the controller 26 acquires the actual topography data. FIG. 8 illustrates an example of the digging wall 53 included in the actual topography 50 as seen from the vehicle width direction. FIG. 9 illustrates an example of the actual topography 50 as seen from the traveling direction of the work machine 1.

The current topographical data includes first slot position data, second slot position data, and digging wall position data. The first slot position data indicates the position of the first slot 51. The second slot position data indicates the position of the second slot 52. The digging wall position data indicates the position of the digging wall 53.

In step S204, the controller 26 acquires the work range data. As illustrated in FIG. 8, the work range includes the starting edge and the terminating edge of the digging. The work range data includes the starting edge position data and the terminating edge position data of the digging. The starting edge position data of the digging indicates the digging starting edge. The terminating edge position data of the digging indicates the digging terminating edge.

Figure 10:
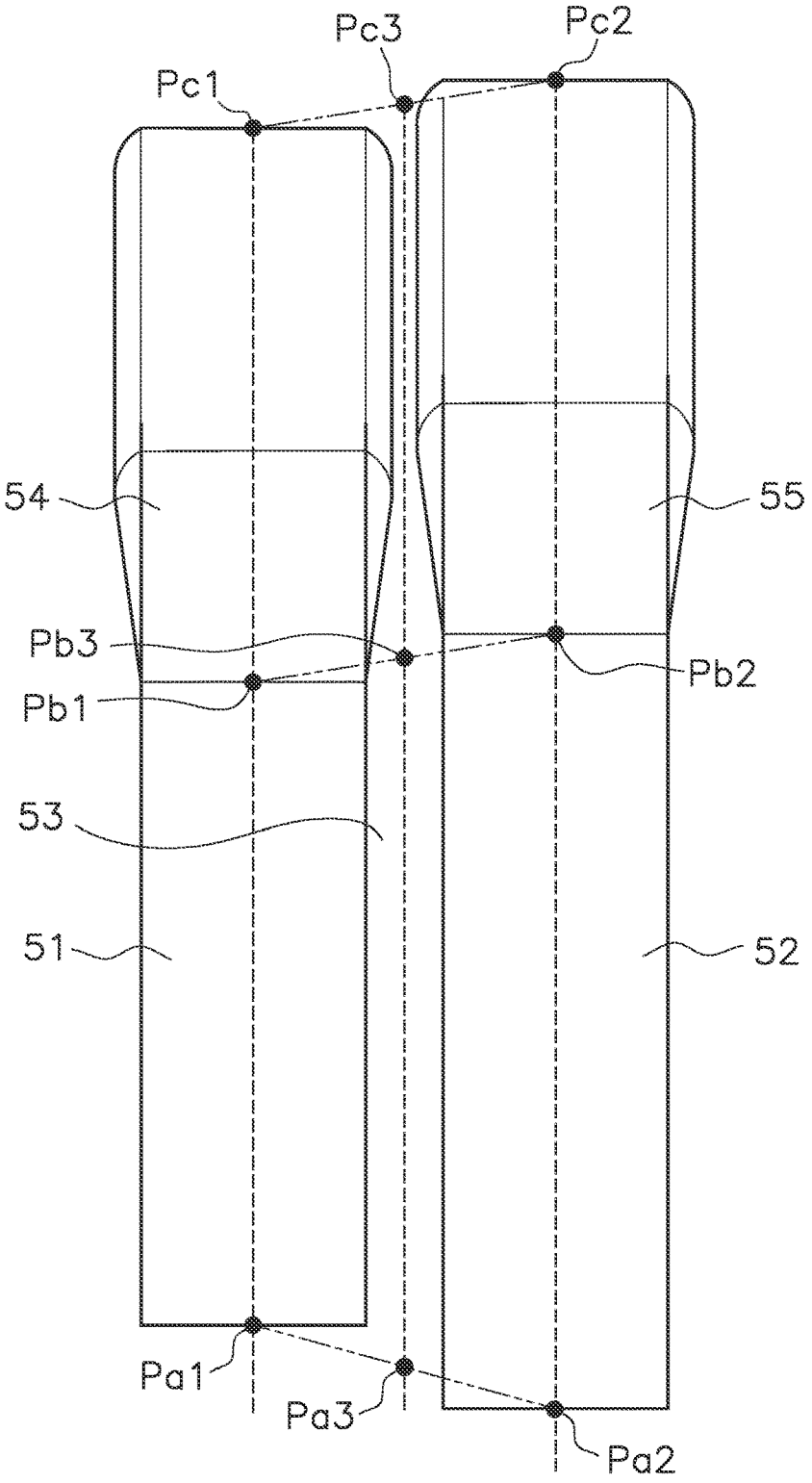
FIG. 10 illustrates a determination method of a work range during the wall digging mode.

FIG. 10 illustrates the actual topography 50 as seen from above. As illustrated in FIG. 10, the controller 26 determines a position Pa3 of the digging starting edge of the digging wall 53 from a position Pa1 of the digging starting edge of the first slot 51, and a position Pa2 of the digging starting edge of the second slot 52. For example, the controller 26 calculates an intermediate position between the position Pa1 of the digging starting edge of the first slot 51 and the position Pa2 of the digging starting edge of the second slot 52. The controller 26 determines the calculated intermediate position as the position Pa3 of the digging starting edge of the digging wall 53. That is, the controller 26 determines the position of a center point of a line that joins the position Pa1 of the digging starting edge of the first slot 51 and the position Pa2 of the digging starting edge of the second slot 52, as the position Pa3 of the digging starting edge of the digging wall 53 as seen in a plan view.

The controller 26 determines a position Pb3 of the digging terminating edge of the digging wall 53 from a position Pb1 of the digging terminating edge of the first slot 51, and a position Pb2 of the digging terminating edge of the second slot 52. For example, the controller 26 calculates an intermediate position between the position Pb1 of the digging terminating edge of the first slot 51 and the position Pb2 of the digging terminating edge of the second slot 52. The controller 26 determines the calculated intermediate position as the position Pb3 of the digging terminating edge of the digging wall 53. That is, the controller 26 determines the position of a center point of a line that joins the position Pb1 of the digging terminating edge of the first slot 51 and the position Pb2 of the digging terminating edge of the second slot 52, as the position Pb3 of the digging terminating edge of the digging wall 53 as seen in a plan view.

In addition, the work range includes the terminating edge of the piled soil as illustrated in FIG. 8. The work range data includes terminating edge position data of the piled soil. The terminating edge position data of the piled soil indicates the terminating edge position of the piled soil. As illustrated in FIG. 10, the controller 26 determines a position Pc3 of the terminating edge of the piled soil of the digging wall 53 from a position Pc1 of the terminating edge of the piled soil of the first slot 51, and a position Pc2 of the terminating edge of the piled soil of the second slot 52. For example, the controller 26 calculates an intermediate position between the position Pc1 of the terminating edge of the piled soil of the first slot 51 and the position Pc2 of the terminating edge of the piled soil of the second slot 52. The controller 26 determines the calculated intermediate position as the position Pc3 of the terminating edge of the piled soil of the digging wall 53. That is, the controller 26 determines a position of a center point of a line that joins the position Pc1 of the terminating edge of the piled soil of the first slot 51 and the position Pc2 of the terminating edge of the piled soil of the second slot 52, as the position Pc3 of the terminating edge of the piled soil of the digging wall 53 as seen in a plan view.

In step S205, the controller 26 acquires the design topography data. For example, the controller 26 determines a target design topography 70*b* of the digging wall 53 as illustrated in FIG. 8. The target design topography 70*b* includes a first target topography 71*b* and a second target topography 72*b*. At least a portion of the first target topography 71*b* is positioned below the digging wall 53. At least a portion of the second target topography 72*b* is positioned above the digging wall 53. However, the second target topography 72*b* may be positioned below the digging wall 53 in the case of dropping the soil down a precipice and removing the soil.

The controller 26 determines a target digging height of the digging wall 53 from the height of the first slot 51 and the height of the second slot 52. The controller 26 determines the target design topography 70 from the target digging height. Specifically, as illustrated in FIG. 9, the controller 26 determines the target digging height of the digging wall 53 from the greater height of the first slot 51 and the second slot 52 (the height of the second slot 52 in FIG. 9). That is, the controller 26 determines the target digging height of the digging wall 53 to match the greater among the heights of the first slot 51 and the second slot 52. The controller 26 then determines the target design topography 70*b* from the target digging height of the digging wall 53.

In step S206, the controller 26 sets the position Pa3 of the digging starting edge of the digging wall 53 acquired in step S204, as a digging starting position Pw1 as illustrated in FIG. 8. The controller 26 is not limited to using the position Pa3 of the digging starting edge of the digging wall 53, and may set another position determined based on the position Pa3 of the starting edge, as the digging starting position Pw1. For example, the controller 26 may set a position spaced away by a predetermined distance from the position Pa3 of the digging starting edge of the digging wall 53, as the digging starting position Pw1.

Figure 11:
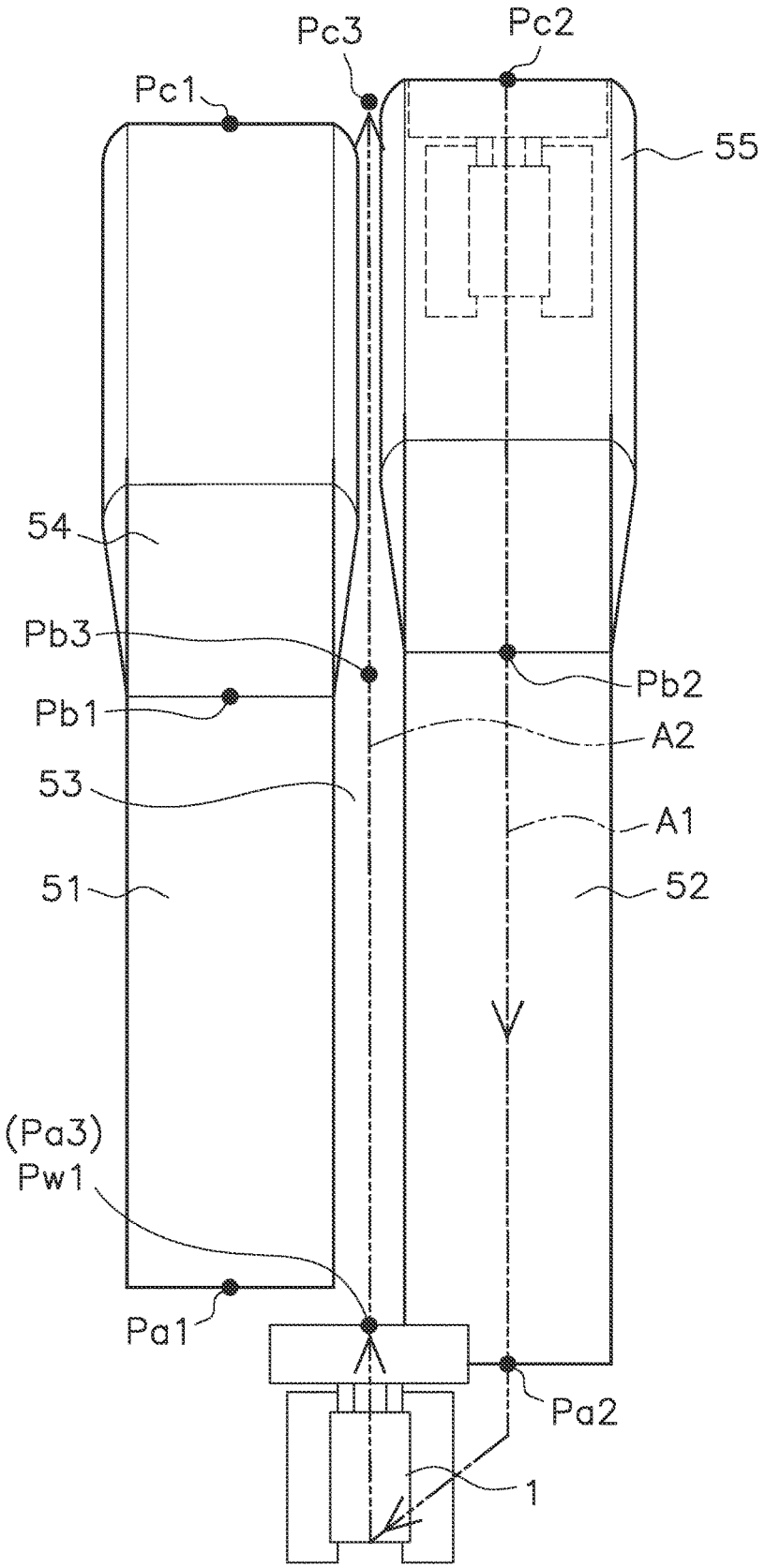
FIG. 11 illustrates motions of the work machine during the wall digging mode.

In step S207, the controller 26 causes the work machine 1 to move to the digging starting position Pw1. At this time, the controller 26 may cause the work machine 1 to move onto the digging wall 53 after traveling in reverse along the second slot 52 as illustrated by arrow A1 in FIG. 11. Alternatively, the controller 26 may cause the work machine 1 to move in reverse along the digging wall 53 after moving onto the digging wall 53.

In step S208, the controller 26 starts the digging of the digging wall 53. The controller 26 controls the work machine 1 in accordance with the target design topography 70*b* of the digging wall 53. Specifically, the controller 26 causes the work machine 1 to travel forward from the digging starting position Pw1 toward the position Pb3 of the digging terminating edge, and controls the work implement 13 so that the blade tip position Pb of the blade 18 moves in accordance with the first target topography 71*b*. The digging wall 53 of the actual topography 50 is dug due to the blade tip of the blade 18 moving along the first target topography 71*b*.

The controller 26 also causes the work machine 1 to travel forward from the position Pc3 of the digging terminating edge to the terminating edge of the piled soil, and controls the work implement 13 so that the blade tip position Pb of the blade 18 moves in accordance with second first target topography 72*b*. The soil dug and held by the blade 18 is piled on the actual topography 50 due to the blade tip of the blade 18 moving along the second target topography 72*b*. Consequently, as illustrated in FIG. 4, the gap between the piled soil 54 corresponding to the first slot 51 and the piled soil 55 corresponding to the second slot 52, is filled in with the dug soil.

In step S209, the controller 26 determines whether to finish the digging of the digging wall 53. For example, the controller 26 may determine to finish the digging of the digging wall 53 when the work machine 1 reaches the terminating edge of the piled soil. Alternatively, the controller 26 may decide to finish the digging in accordance with the operation of the input device 25*b*. Alternatively, the controller 26 may decide to finish the digging of the digging wall 53 in accordance with a previously set construction plan. Although not illustrated in the drawings, the controller 26 may also update the actual topography data in the same way as in step S107 in the wall digging mode.

In the control system 3 of the work machine 1 according to the present embodiment explained above, the controller 26 determines the position of the starting edge of digging of the digging wall 53 as the digging starting position Pw1 upon acquiring the starting command of the wall digging mode. The controller 26 then controls the work machine 1 so as to cause the work machine 1 to move from the digging starting position Pw1 toward the digging terminating edge of the digging wall 53 and dig the digging wall 53 with the work implement 13. Consequently, the digging wall 53 can be dug by means of automatic control of the work machine 1.

The controller 26 determines the digging starting edge of the digging wall 53 from the positions of the digging starting edges of the first slot 51 and the second slot 52 adjacent to the digging wall 53. The controller 26 also determines the position of the digging terminating edge of the digging wall 53 from the positions of the digging terminating edges of the first slot 51 and the second slot 52 adjacent to the digging wall 53. Consequently, the digging wall 53 can be properly reduced in size or removed.

The controller 26 determines the position of the terminating edge of the piled soil of the digging wall 53 from the positions of the terminating edges of the piled soil of the first slot 51 and the second slot 52 adjacent to the digging wall 53. Consequently, the gap between the piled soil 54 corresponding to the first slot 51 and the piled soil 55 corresponding to the second slot 52, can be properly filled in with the dug soil.

The controller 26 determines the target digging height of the digging wall 53 from the height of the first slot 51 and the height of the second slot 52. Consequently, the digging wall 53 can be properly reduced in size or removed.

Although an embodiment of the present invention has been described so far, the present invention is not limited to the above embodiment and various modifications may be made within the scope of the invention.

The work machine 1 is not limited to a bulldozer, and may be another type of machine such as a wheel loader, a motor grader, a hydraulic excavator, or the like. The work machine may be driven by an electric motor. The actual topography may include material such as rocks or iron ore or the like.

The work machine may be a vehicle that can be remotely operated. In this case, a portion of the control system may be disposed outside of the work machine. For example, the controller may be disposed outside the work machine. The controller may be disposed inside a control center separated from the work site. In this case, the work machine may not be provided with an operator's cab.

Figure 12:
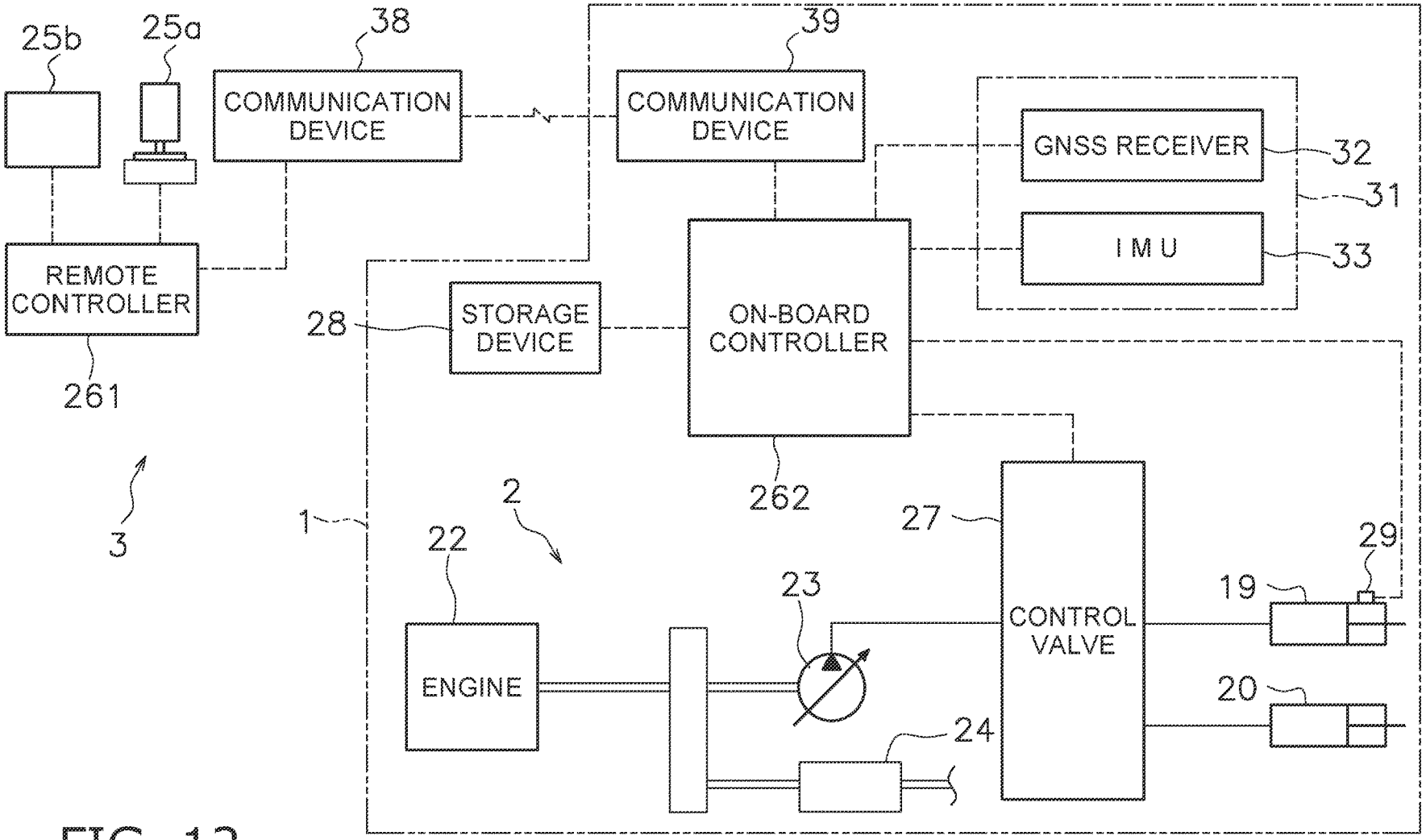
FIG. 12 is a block diagram of a configuration of a drive system and a control system of the work machine according to a first modified example.

The controller may have a plurality of controllers separate from each other. For example as illustrated in FIG. 12, the controller 26 may include a remote controller 261 disposed outside of the work machine and an on-board controller 262 mounted on the work machine. The remote controller 261 and the on-board controller 262 may be able to communicate wirelessly via communication devices 38 and 39. A portion of the abovementioned functions of the controller 26 may be executed by the remote controller 261, and the remaining functions may be executed by the on-board controller 262. For example, the processing for determining the target design topographies 70, 70*a* and 70*b* may be executed by the remote controller 261, and the processing for outputting the command signals to the travel device 12, the work implement 13, the engine 22, the power transmission device 24, etc. may be executed by the on-board controller 262.

The operating device 25*a* and the input device 25*b* may also be disposed outside of the work machine. In this case, the operator's cab may be omitted from the work machine. Alternatively, the operating device 25*a* and the input device 25*b* may be omitted from the work machine.

Figure 13:
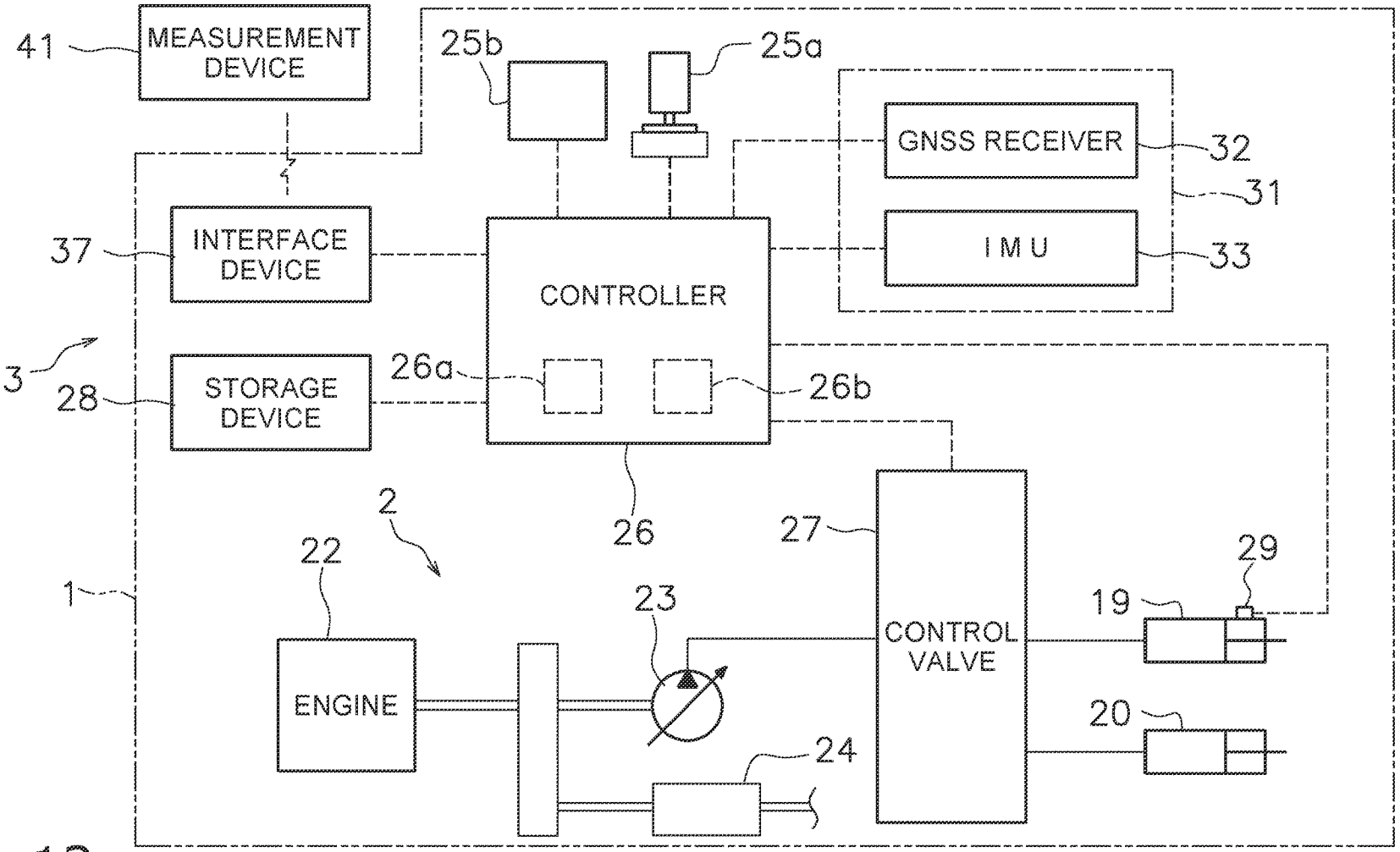
FIG. 13 is a block diagram of a configuration of a drive system and a control system of the work machine according to the first modified example.

The actual topography 50 may be acquired with another device and is not limited to being acquired with the abovementioned positional sensor 31. For example, as illustrated in FIG. 13, the topography 50 may be acquired with an interface device 37 that receives data from an external device. The interface device 37 may wirelessly receive the actual topography data measured by an external measurement device 41. Alternatively, the interface device 37 may be a recording medium reading device and may accept the actual topographical data measured by the external measurement device 41 via a recording medium.

The method for determining the target design topographies 70, 70*a* and 70*b* is not limited to the method of the above embodiment and may be modified. For example, the controller 26 may determine the target design topographies 70, 70*a* and 70*b* based on the load on the work implement 13, a target angle, a target position, or another parameter. Alternatively, the target design topographies 70, 70*a* and 70*b* may be determined in advance with a construction plan.

The work steps of the normal digging mode and the wall digging mode are not limited to those of the above embodiment. For example, the digging of the digging wall 53 between the two slots 51 and 52 is performed after the slots are formed in the above embodiment. However, the digging of a plurality of digging walls between three or more slots may be performed after the three or more slots are formed.

The work range data may be set by the operator operating the input device 25*b* in the wall digging mode. Alternatively, the controller 26 may determine either a position beside the digging starting edge of the first slot 51 or a position beside the digging starting edge of the second slot 52, as the position of the digging starting edge of the digging wall 53. The controller 26 may determine either a position beside the digging terminating edge of the first slot 51 or a position beside the digging terminating edge of the second slot 52, as the position of the digging terminating edge of the digging wall 53. The controller 26 may determine either a position beside the terminating edge of the piled soil of the first slot 51 or a position beside the terminating edge of the piled soil of the second slot 52, as the position of the terminating edge of the piled soil of the digging wall 53.

The controller 26 may determine the target digging height of the digging wall 53 from the lower height among the heights of the first slot 51 and the second slot 52. Alternatively, the controller 26 may determine the target digging height of the digging wall 53 from an intermediate value of the height of the first slot 51 and the height of the second slot 52.

According to the present invention, a digging wall can be dug by means of automatic control of a work machine.

The invention claimed is:

1. A system for automatically controlling a work machine including a work implement, the system comprising:

a processor configured to control the work machine by selectively executing a normal digging mode in order to dig an actual topography at a work site, and a wall digging mode in order to dig a digging wall formed between a plurality of slots by digging the actual topography, the processor being further configured to execute the following in the wall digging mode:

acquire starting edge position data indicative of a position of a starting edge of the digging wall, determine a digging starting position based on the position of the starting edge of the digging wall, acquire slot position data indicative of a position of a slot adjacent to the digging wall, determine a target digging height of the digging wall based on a height of the slot, and control the work machine to dig the digging wall from the digging starting position according to the target digging height.

2. The system according to claim 1, wherein the processor is further configured to acquire slot position data indicative of a position of a slot adjacent to the digging wall, and determine the position of the starting edge of the digging wall from the slot position data.

3. The system according to claim 1, wherein the processor is further configured to acquire terminating edge position data indicative of a position of a terminating edge of the digging wall; and cause the work machine to move from the digging starting position toward the terminating edge.

4. The system according to claim 3, wherein the processor is further configured to acquire slot position data indicative of a position of a slot adjacent to the digging wall, and determine the position of the terminating edge of the digging wall from the slot position data.

5. The work machine system according to claim 3, wherein the processor is further configured to acquire slot position data indicative of positions of left and right slots adjacent to the digging wall, and determine an intermediate position of terminating edges of the left and right slots as the position of the terminating edge of the digging wall.

6. The system according to claim 1, wherein the slot position data is indicative of positions of left and right slots adjacent to the digging wall, and the processor is configured to determine the target digging height of the digging wall based on a height of a higher one of the left and right slots.

7. The system according to claim 1, further comprising:

a positional sensor configured to detect a position of the work machine, the processor being further configured to acquire machine position data indicative of the position of the work machine detected by the positional sensor, and control the work machine to move the work machine to the digging starting position using the machine position data.

8. The system according to claim 1, wherein the processor is further configured to acquire slot position data indicative of positions of left and right slots adjacent to the digging wall, and determine an intermediate position of starting edges of the left and right slots as the position of the starting edge of the digging wall.

9. The system according to claim 1, wherein the processor is configured to determine the target digging height of the digging wall to match the height of the higher one of the left and right slots.

10. A system for automatically controlling a work machine including a work implement, the system comprising:

a processor configured to control the work machine by selectively executing a normal digging mode in order to dig an actual topography at a work site, and a wall digging mode in order to dig a digging wall formed between a plurality of slots by digging the actual topography, the processor being further configured to execute the following in the wall digging mode:

acquire slot position data indicating a first starting edge position of a digging starting edge of a left slot and a second starting edge position of a digging starting edge of a right slot, the left slot and the right slot being adjacent to the digging wall, and determine an intermediate position between the first starting edge position and the second starting edge position as a digging starting position of the digging wall, and control the work machine to dig the digging wall from the digging starting position.

11. The system according to claim 10, wherein the processor is further configured to determine a center point of a line segment joining the first starting edge position and the second starting edge position and use the center point as the digging starting position.

12. A method executed by a processor for automatically controlling a work machine including a work implement, the method comprising:

selectively executing a normal digging mode in order to dig an actual topography at a work site, and a wall digging mode in order to dig a digging wall formed between a plurality of slots by digging the actual topography;

acquiring starting edge position data indicative of a position of a starting edge of the digging wall when the wall digging mode is executed;

determining a digging starting position based on the position of the starting edge of the digging wall;

acquiring slot position data indicative of a position of a slot adjacent to the digging wall;

determining a target digging height of the digging wall based on a height of the slot; and controlling the work machine to dig the digging wall from the digging starting position according to the target digging height.

13. The method according to claim 12, wherein the acquiring of the starting edge position data includes acquiring slot position data indicative of a position of a slot adjacent to the digging wall, and determining the position of the starting edge of the digging wall from the slot position data.

14. The method according to claim 12, wherein the acquiring of the starting edge position data includes acquiring slot position data indicative of positions of left and right slots adjacent to the digging wall, and determining an intermediate position of starting edges of the left and right slots as the position of the starting edge of the digging wall.

15. The method according to claim 12, further comprising:

acquiring terminating edge position data indicative of a position of a terminating edge of the digging wall, the controlling the work machine including causing the work machine to move from the digging starting position toward the terminating edge.

16. The method according to claim 15, wherein the acquiring of the terminating edge position data includes acquiring slot position data indicative of a position of a slot adjacent to the digging wall, and determining the position of the terminating edge of the digging wall from the slot position data.

17. The method according to claim 15, wherein the acquiring of the terminating edge position data includes acquiring slot position data indicative of positions of left and right slots adjacent to the digging wall, and determining an intermediate position of terminating edges of the left and right slots as the position of the terminating edge of the digging wall.

18. The method according to claim 12, wherein the slot position data is indicative of positions of left and right slots adjacent to the digging wall, and the target digging height of the digging wall is determined based on a height of a higher one of the left and right slots.

19. The method according to claim 18, wherein the target digging height of the digging wall is determined to match the height of the higher one of the left and right slots.

20. The method according to claim 12, further comprising:

acquiring machine position data indicative of a position of the work machine; and controlling the work machine to move the work machine to the digging starting position using the machine position data.

* * * * *